United States Patent [19]

Schmidgall

[11] 4,107,360

[45] Aug. 15, 1978

[54] PROCESS FOR PACKING A PASTY STAIN REMOVER IN PORTION CAPSULES

[75] Inventor: Heinz Schmidgall, Teufen, Switzerland

[73] Assignee: Sagapha A. G., Zug, Switzerland

[21] Appl. No.: 810,773

[22] Filed: Jun. 28, 1977

Related U.S. Application Data

[63] Continuation-in-part of Ser. No. 738,890, Nov. 4, 1976.

[51] Int. Cl.[2] ..... B05D 3/02

[52] U.S. Cl. ..... 427/389; 252/90; 252/174; 206/528; 206/530; 427/213

[58] Field of Search ..... 427/3, 212, 213, 389; 252/90, 174; 206/528-539; 53/28, 29

[56] References Cited

U.S. PATENT DOCUMENTS

| | | | |
|---|---|---|---|
| 2,727,833 | 12/1955 | Yen et al. | 427/3 |
| 3,472,675 | 10/1969 | Gordon et al. | 252/DIG. 19 |
| 3,775,334 | 11/1973 | Christie | 252/171 |

FOREIGN PATENT DOCUMENTS

| | | | |
|---|---|---|---|
| 506,752 | 10/1954 | Canada | 427/212 |
| 956,300 | 4/1964 | United Kingdom | 427/212 |

*Primary Examiner*—Ronald H. Smith
*Assistant Examiner*—Sam Silverberg
*Attorney, Agent, or Firm*—Price, Heneveld, Huizenga & Cooper

[57] ABSTRACT

The specification discloses a process for packaging stain remover in individualized gelatine capsules whose exterior surfaces are treated with a solution of a water insoluble plastic material, specifically from about 5 to about 20 parts of post chlorinated polyvinyl chloride per 100 parts of finished solution, in a chlorinated hydrocarbon solvent selected from the group consisting of chloroform, methylene chloride, dichloroethane, trichloroethane, trichloroethylene and combinations thereof.

2 Claims, No Drawings

PROCESS FOR PACKING A PASTY STAIN REMOVER IN PORTION CAPSULES

CROSS REFERENCED TO RELATED APPLICATION

This is a continuation in part of U.S. patent application Ser. No. 738,890 filed Nov. 4, 1976 copending by Dr. Heinz Schmidgall and entitled "A Method for Packing a Stain Removing Material in Paste Form in Dispensing Capsules." The parent case claims priority based on German Patent Application number P2551061.6 filed Nov. 13, 1975.

BACKGROUND OF THE INVENTION

Pasty stain removers have found acceptance as compared with liquid stain removers, because they allow an edgeless removal of stains. Pasty stain removers are filled into tubes and are taken out of the tubes in portions. When doing so make sure that the tube is carefully closed again after having taken the stain remover out of the tube, because the liquid solvent contained in the stain remover would otherwise evaporate and the paste would thus be dried up. However, paste stain removers also dry up, even if this rule is observed, because the formation of hair cracks in the tube casing cannot be avoided, when the tube emptied in portions is rolled up and the solvent also evaporates through these hair cracks.

The filling of the pasty stain remover into an aerosol bottle is a possibility to take a pasty stain remover out of a storage bin in portions without risking the evaporation of the solvent. However, aerosol bottles do not always enjoy general popularity, because the expanding agent contained in the same develops a considerable pressure and because higher temperatures must be strictly avoided and operating instructions such as an exact distance of the aerosol bottle to the garment to be cleaned must be observed when spraying on. The problem of the incorporation in portions of a stain remover in liquid form seems to be already solved. It is known to fill liquid stain removers in portions into glass ampoules being surrounded by a plastics casing having a wick at one end. The glass ampoule is broken within the plastics casing so that the contents can penetrate into the wick and can be applied from there onto the stain to be removed. However, the plastics covering is not always completely safe so that there is the danger that small glass splinters will issue and injuries will result.

A device for the incorporation in portions of a preferably pasty stain remover is suggested in the German Patent Application No. P 24 30 146.0 U.S. Pat. No. 3,993,190 to myself issued on Nov. 23, 1976) in which the disadvantages of the former packing of pasty stain removers and also the deficiencies of the known packing in portions of liquid stain removers are avoided due to the fact that the stain remover is enclosed in capsules being deformable under the influence of pressure, which are preferably inserted individually into receiving recesses of a receiving plate and are covered by a covering film covering said receiving plate.

An easily deformable plastics is preferably used as material for the capsules, the capsules having suitably the shape of bottles. Advantageously a weakened area is provided at the bottleneck which makes it possible to either twist off the bottle neck or to separate it easily in another way.

According to the German Patent Application No. P 25 05 060.6 (U.S. application Ser. No. 638,965 filed Dec. 8, 1975 by myself) the problem is solved additionally to this suggestion to propose a method according to which the pasty stain remover can be filled into the capsules, i.e. which only creates the prerequisites for the use of the device according to the German Patent Application No. P 24 30 146.0.

When solving this problem one already encountered difficulties with regard to the selection of the capsule material.

The plastics films offering themselves for the production of capsules are generally not suited for the packing of pasty stain removers. Stain removers must contain solvents for the stains to be removed, which contain mostly fat. If the stain removers are to have a versatile field of application, hydrocarbons or chlorinated hydrocarbons are used as solvent, which constitute up to 64 percent of the paste. However, these solvents attack the plastics offering themselves for the production of capsules, and cause their swelling and diffusing.

There are of course plastics which can resist the attack of such hydrocarbons or chlorinated hydrocarbons, however, the production and further processing of these plastics is much too expensive so that they cannot be used for a mass product like stain remover capsules.

Gelatine is already known as capsule material for the packing of chemical products, in particular of pharmaceutical products and medicaments. But gelatine is also not suited in general for the packing of pasty stain removers into capsules. Since pasty stain removers have low molecular alcohols, gelatine is dissolved by such alcohols, however such alcohols can at least diffuse to the exterior through the gelatine capsules, whereby the composition of the pasty stain remover is changed in an inadmissible manner.

Stain removers are of course known which do not contain any alcohols, however, the application spectrum of such stain removers is extremely limited so that they have found little acceptance in practice.

For solving the problem on which the German Patent Application No. P 25 05 060.6 is based one had to match or select the composition of the stain remover in such a manner that the capsule material is not attacked by the stain removers or components thereof or that components of the stain remover cannot diffuse through the capsule material.

Only if these requirements were complied with, was it possible to preserve the effectiveness of the pasty stain remover, even if it was packed in capsules being deformable by the influence of pressure.

According to the proposal of the German Patent Application P 25 05 060.6 gelatine is used as capsule material and a fundamentally water-free composition of the pasty stain remover is selected avoiding to a very great extent a portion of low molecular alcohols.

The composition of the pasty stain remover is preferably selected as follows, if gelatine is used as capsule material:

cyclohexanol — 5% to 7%
isopropanol — 0% to 3%
toluene — 15% to 25%
1,2-dichloroethane — 0% to 20%
1,1,1-trichloroethane — 40% to 65%
perfume — 0% to 0.5%
powdery solid matter — 6% to 10%

The used solid matter is present in grain sizes between 5 millimicrons and 150 microns.

SUMMARY OF THE INVENTION

With the proposal according to the present invention the problem is solved to design the capsules using gelatine as capsule material in such a manner that they can also be stored suitably directly, i.e. without inclusion in push-out packages also in areas with a higher air humidity or higher temperatures.

This demand is also raised in our latitudes, e.g. when storing the capsules in the glove compartment of a motor vehicle, if the same must be parked in the sun.

In case of the influence of high air humidity and/or high temperatures the capsules get so soft that the squeezing out of the stain remover can no longer be ensured definitely, and due to the use of such a capsule, there will be further soiling instead of the removal of stains and soilings.

The solution of the problem on which the present invention is based consists in treating the capsule material with a solution of a water-insoluble plastic material, specifically from about 5 to about 20 parts of post chlorinated polyvinyl chloride per 100 parts of finished solution, in a chlorinated hydrocarbon selected from the group consisting of chloroform, methylene chloride, dichloroethane, trichloroethane, trichloroethylene and combinations thereof on the side facing the exterior, when the capsule is finished.

The application of the coating remaining after the evaporation of the chlorinated hydrocarbon on the capsule material which imparts the capsule a higher resistance against the influence of humidity and/or heat can be carried out in several ways.

DESCRIPTION OF THE PREFERRED EMBODIMENT

The gelatine capsules filled with the stain remover or the gelatine sheets to be processed to gelatine capsules — the latter ones preferably only on the side facing the exterior when the capsule is finished can e.g. be sprayed with a solution of the water-insoluble plastic material in a chlorinated hydrocarbon, the chlorinated hydrocarbon evaporating and the desired, water-insoluble plastics coating remaining on the capsule material.

However, a solution of the water-insoluble plastic materials in chlorinated hydrocarbons can also be applied onto the finished filled capsules in a coating boiler, or they can e.g. be sprayed with this solution and the evaporation of the chlorinated hydrocarbons can be adjusted by the adjustment of the temperature and/or the supply and discharge of air in such a manner that a uniform application of the water-insoluble plastic materials on the water-soluble gelatine capsule takes place.

Polyvinyl chloride, polystyrene and polycarbonate which can be dissolved individually or in mixture in chlorinated hydrocarbons such as chloroform, carbon tetrachloride, methylene chloride or the like are suited as water-insoluble plastics materials.

5 to 30 parts of the plastic material(s) are advantageously used for 100 parts of the finished solution.

When coating in the coating boiler care must be taken that a temperature of 40° C is not exceeded. It is suitable worked at room temperature.

It is true that it is already known to coat gelatine capsules with acrylic resins. However, this concerns gelatine capsules being filled with medicaments. Here the problem is concerned to make the capsules e.g. stomach-resistant so that their contents only is effective in the area of the digestive tract following the stomach. The problem on which the invention is based to make gelatine capsules filled with stain removers more resistant against the influence of heat and humidity is not set here.

During further development works it turned out that the process according to the present invention can be substantially improved, if according to the present invention a solution of post-chlorinated polyvinyl chloride in chloroform, methylene chloride, dichloroethane, trichloroethane and/or trichloroethylene in amounts of from 5 to 20 parts of post-chlorinated polyvinyl chloride in 100 parts of finished solution is used for the treatment of the capsule material on the side facing the exterior, when the capsule is finished. This is the most preferred practice of the present invention and yields surprisingly superior results over the broader aspects of the invention.

When using these substances not only a better solubility of the coating material in the solvent, but and this is a special advantage - also the formation of coating films cohering perfectly and a better adhesion of the same on the capsule material is achieved.

These advantages can still be increased, if in a further development of the invention the coating of the capsules with the coating material is carried out in a fluidized bed drier.

I claim:

1. In a method for packaging a basically anhydrous pasty stain remover which is substantially free of low molecular weight alcohols in portion capsules using gelatine as the supporting wall material of the portion capsules, said capsules being sufficiently large only to contain a sufficient amount of stain remover to treat a typical individual stain and being deformable under the influence of pressure, wherein the improvement comprises: coating the (finished, filled) exterior surface of the capsule material with a solution of a water-insoluble plastic material in a chlorinated hydrocarbon characterized in that said solution consists of from about five to twenty parts of post-chlorinated polyvinyl chloride per 100 parts of finished solution in a solvent selected from the group consisting of chloroform, methylene chloride, dichloroethane, trichloroethane and trichloroethylene and combinations thereof.

2. A process according to claim 1, characterized in that the coating step is carried out in a fluidized bed drier.

* * * * *